US007138221B2

(12) United States Patent
Yamada

(10) Patent No.: US 7,138,221 B2
(45) Date of Patent: Nov. 21, 2006

(54) PHOTOTHERMOGRAPHIC MATERIAL

(75) Inventor: Sumito Yamada, Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/263,692

(22) Filed: Oct. 4, 2002

(65) Prior Publication Data

US 2003/0138740 A1 Jul. 24, 2003

(30) Foreign Application Priority Data

Oct. 5, 2001 (JP) ..... P2001-309951

(51) Int. Cl.
*G03C 5/16* (2006.01)
*G03C 1/498* (2006.01)

(52) U.S. Cl. ..... 430/350; 430/619; 430/620

(58) Field of Classification Search ..... 430/619, 430/350, 620, 567, 668; 396/575
See application file for complete search history.

(56) References Cited

U.S. PATENT DOCUMENTS

| | | | | |
|---|---|---|---|---|
| 2,910,377 | A | 10/1959 | Owen | |
| 3,152,904 | A | 10/1964 | Sorenson, et al. | |
| 3,457,075 | A | 7/1969 | Morgan | |
| 5,677,121 | A * | 10/1997 | Tsuzuki | 430/619 |
| 5,998,126 | A * | 12/1999 | Toya et al. | 430/619 |
| 6,143,488 | A * | 11/2000 | Uytterhoven et al. | 430/619 |
| 6,791,593 | B1 * | 9/2004 | Goto et al. | 347/228 |

FOREIGN PATENT DOCUMENTS

| | | |
|---|---|---|
| EP | 1096310 A2 * | 5/2001 |
| JP | 43-4924 | 2/1968 |

* cited by examiner

*Primary Examiner*—Thorl Chea
(74) *Attorney, Agent, or Firm*—Sughrue Mion, PLLC

(57) ABSTRACT

A photothermographic material comprising: a transparent support; and a photosensitive layer comprising a photosensitive silver halide, a non-photosensitive organic silver salt, a thermal developer and a binder, wherein the photosensitive silver halide comprises silver iodide in a ratio of 5% by mole or more, the non-photosensitive organic silver salt comprises silver behenate in a ratio of 30% by mole or more and less than 80% by mole, and the binder has a glass transition temperature of 45° C. or more.

9 Claims, No Drawings

PHOTOTHERMOGRAPHIC MATERIAL

FIELD OF THE INVENTION

The present invention relates to a photothermographic material (thermal development photosensitive material) and a process for forming an image, and more particularly, it relates to a photothermographic material that exhibits high sensitivity and excellent image storage stability and causes low fogging on a non-image part, and a process for forming an image using the photothermographic material.

BACKGROUND OF THE INVENTION

In recent years, reduction in amount of waste solutions to be processed is highly demanded in the fields of films for medical diagnosis and films for photochemical engraving from the standpoint of environmental protection and space saving. Therefore, such techniques are necessitated that relates to photothermographic materials as films for medical diagnosis and films for photochemical engraving that can be efficiently exposed with a image setter or a laser imager and can form a sharp black image having high resolution and sharpness. According to the photothermographic materials, such a simple and environmentally friendly thermal development processing system can be supplied to the customers that does not require any solvent system processing chemical.

While there is the similar demand in the field of ordinary image forming materials, images of cold black tone are characteristically appreciated because the images for medical diagnosis are particularly required to have high image quality excellent in sharpness and graininess owing to the demand of fine depiction, and to exert convenience in diagnosis. Various kinds of hard copy output systems, such as ink-jet printers and electrophotography, utilizing pigments and dyes are currently available as an ordinary image forming system, but there is no system that is sufficient as an output system for medical images.

Thermal image forming systems utilizing an organic silver salt are disclosed, for example, in U.S. Pat. No. 3,152,904 and No. 3,457,075, and D. Klosterboer, "Thermally Processed Silver Systems", Imaging Processes and Materials, Neblette 8th edition, edited by J. Sturge, V. Walworth and A. Shepp, Chapter 9, page 279 (1989).

In particular, a photothermographic material generally has a photosensitive layer having a catalytically active amount of a photocatalyst (such as a silver halide), a reducing agent, a reducible silver salt (such as an organic solver salt), and depending on necessity, a toning agent controlling the tone of silver, which are dispersed in a binder matrix. The photothermographic material is subjected to imagewise exposure and then heated to a high temperature (for example, 80° C. or higher) to form a black silver image through a redox reaction between the reducible silver salt (functioning as an oxidizing agent) and the reducing agent. The redox reaction is accelerated by the catalytic function of a latent image of silver halide formed by the exposure. Therefore, the black silver image is formed in the exposed region. The photothermographic materials are disclosed in many literatures including U.S. Pat. No. 2,910,377 and JP-B-43-4924 (The term "JP-B" as used herein means an "examined Japanese patent application")

SUMMARY OF THE INVENTION

An object of the invention is to provide such a photothermographic material that uses a silver halide containing silver iodide in a high concentration (a high silver iodide silver halide) as a photosensitive silver halide, is excellent in image storage stability after image formation, and can provide an image of high sensitivity and high image quality.

Another object of the invention is to provide a process for forming an image using the photothermographic material.

The objects of the invention are attained by the photothermographic material and the process for forming an image shown below.

1. A photothermographic material containing a transparent support having thereon at least one photosensitive layer containing a photosensitive silver halide, a non-photosensitive organic silver salt, a thermal developer and a binder, characterized in that (a) the photosensitive silver halide contains silver iodide in a ratio of at least 5% by mole (mole percent), (b) the non-photosensitive organic silver salt contains silver behenate in a ratio of 30% by mole or more and less than 80% by mole, and (c) the binder has a glass transition temperature of 45° C. or more.

2. A photothermographic material as described in the item 1, characterized in that the photosensitive silver halide has a particle size of from 5 to 80 nm.

3. A photothermographic material as described in the item 1, characterized in that the photosensitive silver halide contains silver iodide in a ratio of 10% by mole.

4. A photothermographic material as described in the item 3, characterized in that the photosensitive silver halide contains silver iodide in a ratio of 40% by mole.

5. A photothermographic material as described in one of the items 1 to 4, characterized in that the binder contains polyvinyl butyral in an amount of 50% by weight or more.

6. A process for forming an image characterized by containing exposing a photothermographic material as described in one of the items 1 to 5 to light having a peak intensity at a wavelength of from 350 to 440 nm and an illuminance of 1 $mW/mm^2$ or more, and then subjecting the same to thermal development.

7. A process for forming an image as described in the item 6, characterized in that the heat development is conducted with a heat drum thermal developing apparatus.

DETAILED DESCRIPTION OF THE INVENTION

Implementation methods and embodiments of the invention will be described in detail below.

The photothermographic material of the invention contains an organic silver salt. The organic silver salt that can be used in the invention is such a silver salt that is relatively stable to light but forms a silver image upon heating to 80° C. or higher in the presence of an exposed photocatalyst (such as a latent image of a photosensitive silver halide) and a reducing agent. The organic silver salt may be an arbitrary organic substance containing a source that can reduce a silver ion, but one of the characteristic features of the invention is that silver behenate occupies 30% by mole or more and less than 80% by mole, preferably from 40 to 75% by mole, and particularly preferably from 50 to 70% by mole, of the total organic silver salt contained in the photothermographic material. Examples of other silver salts of organic acids include silver salts of a long chain aliphatic carboxylic acid preferably having a carbon number of from 10 to 30, and more preferably from 15 to 28. A complex of an organic or inorganic silver salt having a ligand of a complex stability coefficient in a range of from 4.0 to 10.0 is also preferred. These non-photosensitive silver salts are disclosed in paragraphs 0048 to 0049 of JP-A-10-62899 (The term "JP-A" as used herein means an "unexamined published Japanese patent application"), page, 18, line 24 to page 19, line 37 of EP 0,803,764 A1, EP 0,962,812 A1, JP-A-11-349591, JP-A-2000-7683, JP-A-2000-72711 and the like.

Preferred examples of the organic silver salt include a silver salt of an organic compound having a carboxyl group, and examples thereof include a silver salt of an aliphatic carboxylic acid and a silver salt of an aromatic carboxylic acid, but are not limited thereto. Preferred examples of the silver salt of an aliphatic carboxylic acid include, in addition to silver behenate, silver stearate, silver oleate, silver laurate, silver caproate, silver myristate, silver palmitate, silver maleate, silver fumarate, silver tartrate, silver linoleate, silver butyrate, silver camphorate, mixtures thereof and the like.

The organic silver salt as a silver supplying substance preferably constitutes about from 5 to 30% by weight of the image forming layer (photosensitive layer).

The shape of the organic silver salt that can be used in the invention is not particularly limited, and acicular crystals having short axes and long axes are preferred. It has been well known in the field of silver halide photographic photosensitive materials that there is inverse proportionality relationship between the size of the silver salt crystal particles and the covering power thereof. The relationship is also effective in the photothermographic material in the invention, and when the organic silver salt particles as an image forming part of the photothermographic material are large, this means that the covering power is small, and the image density is low. Therefore, the size of the organic silver salt is preferably small. It is preferred in the invention that the short axis is from 0.01 to 0.20 μm with the long axis being from 0.10 to 5.0 μm, and more preferably the short axis is from 0.01 to 0.15 μm with the long axis being from 0.10 to 4.0 μm.

The particle size distribution of the organic silver salt is preferably monodisperse. Monodisperse means such conditions that the percentage of the value obtained by dividing the standard deviations of the short axis and the long axis by the short axis and the long axis, respectively, is preferably 100% or less, more preferably 80% or less, and further preferably 50% or less. The shape of the organic silver salt can be obtained by the measurement method using a transmission electromicrograph of an organic silver salt dispersion. Another method for measuring the monodispersibility include a method of obtaining the standard deviation of the volume weighted average diameter of the organic silver salt, and the percentage of the value obtained by dividing by the volume weighted average diameter (variation coefficient) is preferably 100% or less, more preferably 80% or less, and further preferably 50% or less. As a measurement method therefor, it can be obtained from the particle size (volume weighted average particle diameter) obtained, for example, in such manner that the organic silver salt dispersed in a liquid is irradiated with laser light, and the auto-correlation function of the scattered light with respect to time change is obtained.

The particles of the organic silver salt that can be used in the invention are formed in an aqueous solution, and then dried to obtain as organic silver salt particles. Drying is preferably carried out with an air flow flash jet dryer at an oxygen partial pressure of from 0.01 to 15% by volume, and more preferably from 0.01 to 10% by volume.

The organic silver salt particles are prepared by dispersing in a solvent, such as MEK (methyl ethyl ketone) or the like, and then used for production of the photosensitive material.

The organic silver salt can be used in an arbitrary amount, and the silver coated amount is preferably from 0.1 to 5 $g/m^2$, and more preferably from 1 to 3 $g/m^2$.

The photothermographic material of the invention contains a photosensitive silver halide. The silver iodide content of the silver halide of the invention is preferably from 5 to 100% mole. The silver iodide content is more preferably from 10 to 100% by mole, further preferably from 40 to 100% by mole, still further preferably from 70 to 100% by mole, and particularly preferably from 90 to 100% by mole. When such a higher silver iodide content is used, the effect of the invention is exerted more conspicuously.

The silver halide of the invention preferably exhibits a direct transition absorption ascribed to the silver iodide crystal structure at a wavelength in a range of from 350 to 440 nm. It can be easily distinguished by observing exciton absorption ascribed to the direct transition in the vicinity of from 400 to 430 nm as to whether or not the silver halide has light absorption of the direct transition.

The direct transition light absorbing high silver iodide phase may be solely present, but it is also preferably used that it is present with junction to a silver halide exhibiting indirect transition absorption in a wavelength range of from 350 to 440 nm, such as a silver bromide emulsion, a silver chloride emulsion, silver iodobromide emulsion, a silver iodochloride emulsion and mixed crystals thereof. In the case of such junction particles, the total silver iodide content is preferably from 5 to 100% by mole. The average silver iodide content is more preferably from 10 to 100% mole, further preferably from 40 to 100% by mole, still further preferably from 70 to 100% by mole, and particularly preferably from 90 to 100% by mole.

The silver halide phase that absorbs light through direct transition generally exhibits strong light absorption, but it has low sensitivity in comparison to the indirect transition silver halide phase exhibiting only weak absorption, and thus has not been industrially utilized. In the invention, it has been found that upon exposure of the silver halide photosensitive material in a range of from 350 to 440 nm, preferred sensitivity can be obtained by using an exposure illuminance of 1 $mW/mm^2$ or more.

The wavelength for the exposure is more preferably from 350 to 430 nm, and particularly preferably from 380 to 410 nm.

The silver halide of the invention favorably exhibits the characteristics thereof when the particle size thereof is from 5 to 80 nm. Particularly, it has been found that in the silver halide particles having the phase exhibiting the direct transition absorption, the sensitivity is obtained when the particle size thereof is as small as 80 nm or less.

The particle size of the photosensitive silver halide is more preferably from 5 to 60 nm, and further preferably from 10 to 50 nm. The particle size referred herein means a diameter of a circular image having the same area as a projected area of the silver halide particles (a projected area of the major plane in the case of acicular particles).

The formation method of the photosensitive silver halide used in the invention has been well known in this field of art, and the methods disclosed in Research Disclosure, No. 17029, June of 1978 and U.S. Pat. No. 3,700,458 can be used. Specific examples of the method that can be used in the invention include a method, in which a halogen-containing compound is added to the prepared organic silver salt to convert a part of silver of the organic silver salt to a photosensitive silver halide, and a method, in which a silver supplying compound and a halogen supplying compound are added to a solution of gelatin or other polymers to prepare photosensitive silver halide particles, which are then mixed with an organic silver salt. In the invention, the later method is preferably used.

The particle size of the photosensitive silver halide is preferably small in order to suppress white turbidity after image formation to a low level, and specifically, it is preferably from 0.01 to 0.15 μm, and more preferably from 0.02 to 0.10 μm. When the particle size of the silver halide is too small, the sensitivity is insufficient, and it is too large, there are some cases where a problem of increased haze of the photosensitive material occurs. The particle size referred herein means the length of the edge of the silver halide particles when the silver halide particles are so-called normal crystals of a cube or an octahedron. In the case where the silver halide particles are tabular particles, it means a diameter of a circular image having the same area as a projected area of the major plane. In the case of other abnormal crystals, for example, spherical particles, columnar particles and the like, it means a diameter of a sphere that is equivalent to the volume of the silver halide particles.

Examples of the shape of the silver halide particles include a cube, an octahedron, tabular particles, spherical particles, columnar particles, potato-like particles and the like, and cubic particles and tabular particles are particularly preferred in the invention. In the case where tabular silver halide particles are used, the average aspect ratio is preferably from 100/1 to 2/1, and more preferably from 50/1 to 3/1. Furthermore, silver halide particles having rounded corners are also preferably used. The plane index (Miller index) of the outer surface of the photosensitive silver halide particles is not particularly limited, and it is preferred that the ratio occupied by the {100} plane is high that exhibits a high spectral sensitization efficiency in the case where a spectral sensitizing dye is adsorbed. The ratio is preferably 50% or more, more preferably 65% or more, and further preferably 80% or more. The Miller index and the ratio of the {100} plane can be obtained by the method disclosed in T. Tani, J. Imaging Sci., vol. 29, p. 165 (1985) utilizing the adsorption dependency of the {111} plane and the {100} plane upon adsorption of a sensitizing dye.

The halogen composition structure of the interior of the photosensitive silver halide particles is not particularly limited. The distribution of the halide composition inside the particles may be uniform, or the halogen composition is changed stepwise or changed continuously, and high silver iodobromide particles having a high silver iodide content inside the particles can be used as a preferred example. Furthermore, silver halide particles having a core/shell structure can be preferably used. As the structure thereof, core/shell particles having a twofold to fivefold structure, more preferably a twofold to fourfold structure, are preferably used.

The photosensitive silver halide particles used in the invention preferably contains at least one kind of metallic complexes of a metal selected from rhodium, rhenium, ruthenium, osmium, iridium, cobalt, mercury and iron. The metallic complexes may be used singly or may be used in combination of two or more kinds of complexes of the same kind of metal or different kinds of metal. The content thereof is preferably in a range of from 1 nanomole (nmol) to 10 millimole (mmol) per 1 mole of silver, and more preferably in a range of from 10 nanomole (nmol) to 100 micromole (μmol). As a specific structure of the metallic complex, metallic complexes having the structure disclosed in JP-A-7-225449 and the like can be used. As for the compounds of cobalt and iron, a hexacyano metallic complex is preferably used. Specific examples thereof include a ferricyanate ion, a ferrocyanate ion, hexacyanocobaltate ion and the like, but it is not limited thereto. The phase containing the metallic complex in the silver halide may be uniform, or it may be contained at a high concentration in the core part or at a high concentration in the shell part, without particular limitation.

The photosensitive silver halide particles in the invention are preferably chemically sensitized. As a preferred chemical sensitization method, a sulfur sensitization method, a selenium sensitization method and tellurium sensitization method can be used as well known in this field of art. A noble metal sensitization method using a gold compound or a platinum, palladium or iridium compound, and a reduction sensitization method can be used. As a compound that is preferably used in the sulfur sensitization method, the selenium sensitization method and the tellurium sensitization method, known compounds can be used, and the compounds disclosed in JP-A-7-128768 and the like can be used.

The using amount of the photosensitive silver halide in the invention is preferably from 0.01 to 0.5 mole, more preferably from 0.02 to 0.3 mole, and particularly preferably from 0.03 to 0.25 mole, per 1 mole of the organic silver salt. The mixing method and the mixing conditions of the photosensitive silver halide and the organic silver salt that are separately prepared may be a method, in which the silver halide particles and the organic silver salt having been completed are mixed with a high speed mill, a ball mill, a sand mill, a colloid mill, a vibration mill, a homogenizer or the like, and a method, in which the photosensitive silver halide having been completed is mixed with the organic silver salt at certain timing during the preparation thereof to prepare the organic silver salt, and there is not particular limitation as far as the effect of the invention is sufficiently exerted.

As the preparation method of the silver halide used in the invention, a so-called halogenation method, in which a part of the silver of the organic silver halide is halogenated with an organic or inorganic halide, can also be preferably used.

The organic halide used herein may be any compound as far as it is a compound forming a silver halide through reaction with an organic silver salt, and examples thereof include an N-halogenoimide (such as N-bromosuccinimide and the like), a halogenated quaternary nitrogen compound (such as tetrabutylammonium bromide and the like), an associated body of a halogenated quaternary nitrogen salt and a halogen molecule (such as perbrominated pyridinium bromide), and the like.

The inorganic halide may be any compound as far as it is a compound forming a silver halide through reaction with an organic silver salt, and examples thereof include a alkali metal halide or an ammonium halide (such as sodium chloride, lithium bromide, potassium iodide, ammonium bromide and the like), an alkaline earth metal halide (such as calcium bromide, magnesium chloride and the like) a transition metal halide (such as ferric chloride, cupric bromide and the like), a metallic complex having a halogen ligand (such as brominated sodium iridate, chlorinated ammonium rhodate and the like), a halogen molecule (such as bromine, chlorine and iodine), and the like. Furthermore, desired organic or inorganic compounds may be used in combination.

The addition amount of the halide upon carrying out the halogenation is preferably from 1 to 500 millimole, and more preferably from 10 to 250 millimole, per 1 mole of the organic silver salt.

In the photothermographic material of the invention, a sensitizing dye may be contained along with the silver halide particles. As the sensitizing dye that can be applied to the invention, those being capable of spectrally sensitizing the silver halide particles in a desired wavelength region upon adsorbing on the silver halide particles and having spectral sensitivity suitable for the spectral characteristics of the exposure light source can be advantageously selected. The sensitizing dyes and the addition method are disclosed in paragraphs 0103 to 0109 of JP-A-11-65021, the compounds represented by the formula (II) of JP-A-10-186572, the dyes represented by the formula (I) and paragraph 0106 of JP-A-11-119374, U.S. Pat. No. 5,510,236, U.S. Pat. No. 5,541,054, the dyes disclosed in Example 5 of U.S. Pat. No. 3,871,887, JP-A-2-96131, the dyes disclosed in JP-A-59-48753, page 19, line 38 to page 20, line 35 of EP 0,803,764 A1, Japanese Patent Application No. 2000-86865, Japanese Patent Application No. 2000-102560 and the like. These sensitizing dyes may be used singly or in combination of two or more of them.

The addition amount of the sensitizing dye in the invention may be a desired amount in view of the performance including the sensitivity and the fogging, and it is preferably from $10^{-6}$ to 1 mole, and more preferably from $10^{-4}$ to $10^{-1}$ mole, per 1 mole of silver halide in the photosensitive layer. A combination of sensitizing dyes is often used for chromatic sensitization. A dye having no spectral sensitization function by itself or a substance that substantially does not absorb visible ray that exhibits chromatic sensitization may be contained in the emulsion. The useful sensitizing dye, the combination of dyes exhibiting chromatic sensitization and the substance exhibiting chromatic sensitization are disclosed in page 23, item IV J of Research Disclosure, vol. 176, No. 17643 (December of 1978), JP-B-49-25500, JP-B-43-4933, JP-A-59-19032, JP-A-59-192242 and the like.

The photothermographic material of the invention preferably contains a thermal developer as a reducing agent for the organic silver salt. The reducing agent for the organic silver salt may be an arbitrary substance that reduces a silver ion to metallic silver, and is preferably an organic substance. Examples of the reducing agent are disclosed in paragraphs 0043 to 0045 of JP-A-11-65021 and page 7, line 34 to page 18, line 12 of EP 0,803,764 A1.

In the invention, a so-called hindered phenol reducing agent or bisphenol reducing agent having a substituent on an ortho position of the phenolic hydroxyl group is preferred as the reducing agent, and a compound represented by the following formula (I) is more preferred.

(I)

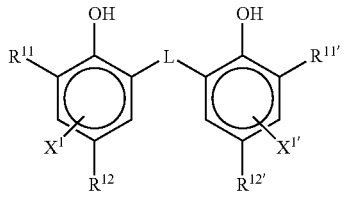

(In the formula (I), $R^{11}$ and $R^{11'}$ each independently represents an alkyl group having from 1 to 20 carbon atoms; $R^{12}$ and $R^{12'}$ each independently represents a hydrogen atom or a substituent that can be substituted to a benzene ring; L represents an —S— group or a —$CHR^{13}$— group, $R^{13}$ represents a hydrogen atom or an alkyl group having from 1 to 20 carbon atoms, and $X^1$ and $X^{1'}$ each independently represents a hydrogen atom or a substituent that can be substituted to a benzene ring.)

The formula (I) will be described in detail.

$R^{11}$ and $R^{11'}$ each independently represents a substituted or unsubstituted alkyl group having from 1 to 20 carbon atoms. The substituent for the alkyl group is not particularly limited, and preferred examples thereof include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group, a halogen atom and the like.

$R^{12}$ and $R^{12'}$ each independently represents a hydrogen atom or a substituent that can be substituted to a benzene ring, and $X^1$ and $X^{1'}$ also each independently represents a hydrogen atom or a substituent that can be substituted to a benzene ring. Preferred examples of the substituent that can be substituted to a benzene ring include an alkyl group, an aryl group, a halogen atom, an alkoxy group and an acylamino group.

L represents an —S— group or a —$CHR^{13}$— group. $R^{13}$ represents a hydrogen atom or an alkyl group having from 1 to 20 carbon atoms, and the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group, a 2,4,4-trimethylpentyl group and the like. Examples of the substituent of the alkyl group include the similar groups as the substituent of $R^{11}$.

$R^{11}$ and $R^{11'}$ are preferably a secondary or tertiary alkyl group having from 3 to 15 carbon atoms, and specific examples thereof include an isopropyl group, an isobutyl group, a t-butyl group, a t-amyl group, a t-octyl group, a cyclohexyl group, a cyclopentyl group, a 1-methylcyclohexyl group, a 1-methylcyclopropyl group and the like. $R^{11}$ and $R^{11'}$ are more preferably an alkyl group having from 4 to 12 carbon atoms, and particularly a t-butyl group, a t-amyl group and a 1-methylcyclohexyl group are more preferred, with a t-butyl group being most preferred.

$R^{12}$ and $R^{12'}$ are preferably an alkyl group having from 1 to 20 carbon atoms, and specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and the like. It is more preferably a methyl group, an ethyl group, a propyl group, an isopropyl group and a t-butyl group.

$X^1$ and $X^{1'}$ are preferably a hydrogen atom, a halogen atom or an alkyl group, and a hydrogen atom is more preferred.

L preferably represents a —$CHR^{13}$— group.

$R^{13}$ is preferably a hydrogen atom or an alkyl group having from 1 to 15 carbon atoms, and the alkyl group is preferably a methyl group, an ethyl group, a propyl group, an isopropyl group and a 2,4,4-trimethylpentyl group. $R^{13}$ is particularly preferably a hydrogen atom, a methyl group, an ethyl group, a propyl group and an isopropyl group. In the case where $R^{13}$ is a hydrogen atom, $R^{12}$ and $R^{12'}$ each preferably represents an alkyl group having from 2 to 5 carbon atoms, more preferably an ethyl group or a propyl group, and most preferably an ethyl group. In the case where $R^{13}$ is a primary or secondary alkyl group having from 1 to 8 carbon atoms, $R^{12}$ and $R^{12'}$ each is preferably a methyl group. Preferred examples of the primary or secondary alkyl group having from 1 to 8 carbon atoms include a methyl group, an ethyl group, a propyl group and an isopropyl group, and a methyl group, an ethyl group and a propyl group are further preferred.

In the case where all of $R^{11}$, $R^{11'}$, $R^{12}$ and $R^{12'}$ are methyl groups, $R^{13}$ is preferably a secondary alkyl group. The secondary alkyl group of $R^{13}$ is preferably an isopropyl group, an isobutyl group and a 1-ethylpentyl group, and more preferably an isopropyl group.

The reducing agents represented by the formula (I) are different in thermal developability and color tone of developed silver depending on the combinations of $R^{11}$, $R^{11'}$, $R^{12}$, $R^{12'}$ and $R^{13}$. These can be adjusted by combining two or more kinds of reducing agents, and thus they are preferably used in combination of two or more thereof depending on the purpose.

Specific examples of the reducing agent of the invention including the compounds represented by the formula (I) will be shown below, but the invention is not limited to them.

(I-1)

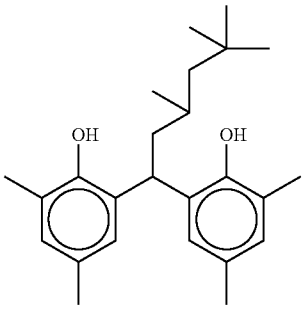

(I-2)

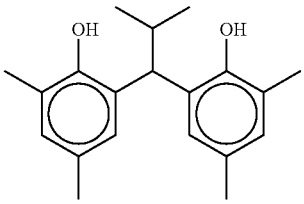

(I-3)

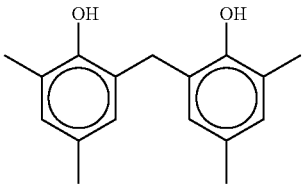

(I-4)

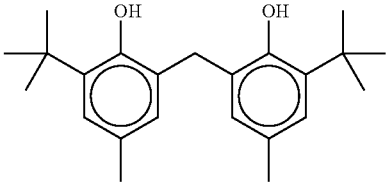

-continued (I-5)

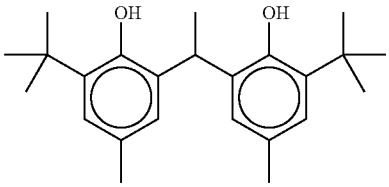

(I-6)

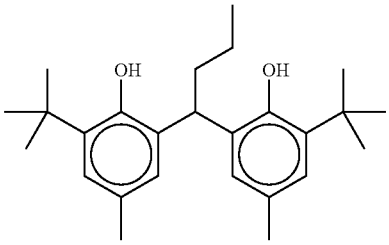

(I-7)

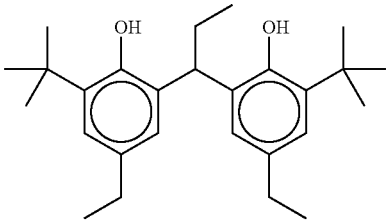

(I-8)

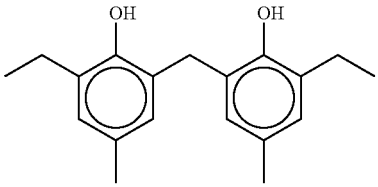

(I-9)

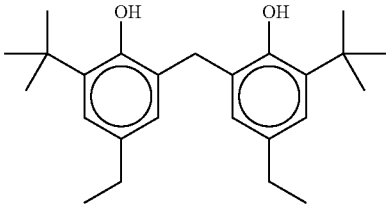

(I-10)

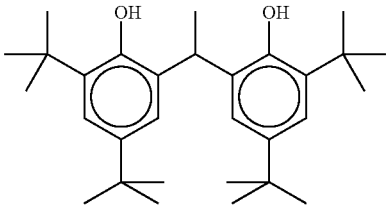

(I-11)

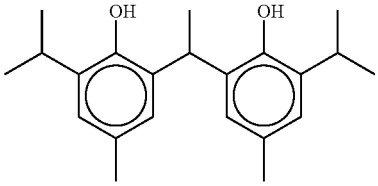

-continued (I-12)

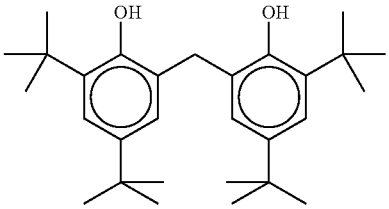

(I-13)

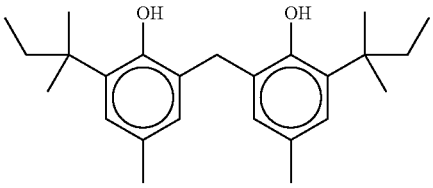

(I-14)

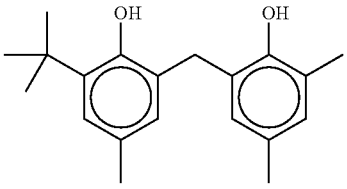

(I-15)

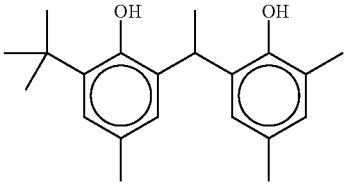

(I-16)

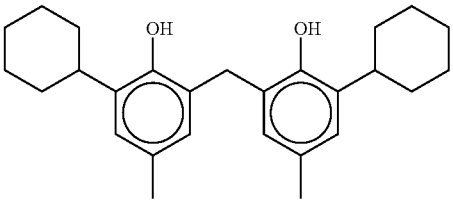

(I-17)

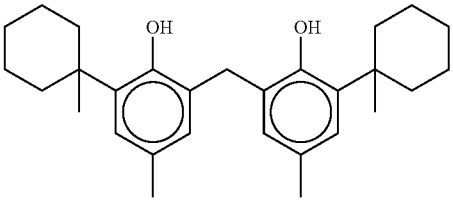

(I-18)

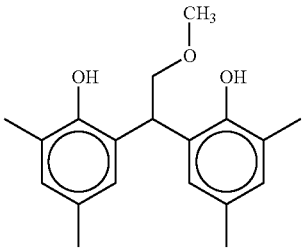

-continued (I-19)

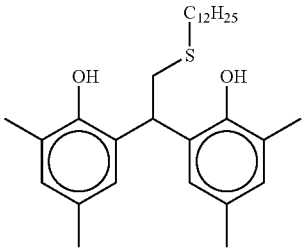

(I-20)

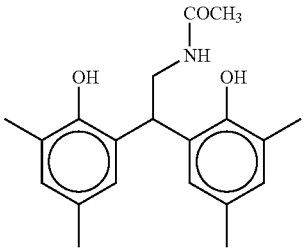

(I-21)

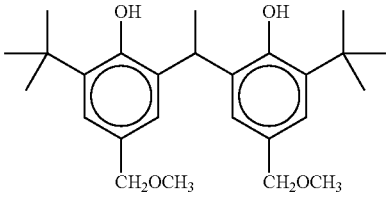

(I-22)

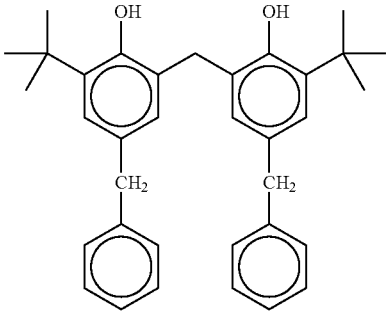

(I-23)

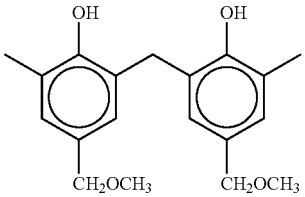

The reducing agent is preferably contained in the image forming layer (photosensitive layer).

In the invention, as the reducing agent for the organic silver salt, other reducing agents may be used in combination with the compound represented by the formula (I). The reducing agent that can be used in combination for the organic silver salt may be an arbitrary substance capable of reducing a silver ion to metallic silver and is preferably an organic substance. Such reducing agents are disclosed in paragraphs 0043 to 0045 of JP-A-11-65021 and page 7, line 34 to page 18, line 12 of EP 0,803,764 A1. Among these, a hindered phenol reducing agent and a bisphenol reducing agent are preferred.

In the invention, the addition amount of the reducing agent represented by the formula (I) is preferably from 0.01 to 5.0 g/m$^2$, and more preferably from 0.1 to 3.0 g/m$^2$, and on the surface having the image forming layer (photosensitive layer), it is preferably contained in an amount of from 0.05 to 0.5 mole, and more preferably from 0.1 to 0.4 mole, per 1 mole of silver.

The reducing agent is preferably contained in the image forming layer.

The binder in the photothermographic material of the invention may be arbitrary ones selected from natural or synthetic resins, such as gelatin, polyvinyl butyral, polyvinyl acetal, polyvinyl chloride, polyvinyl acetate, cellulose acetate, polyolefin, polyester, polystyrene, polyacrylonitrile, polycarbonate, polyvinyl butyral, butylethylcellulose, a methacrylate copolymer, a maleic anhydride ester copolymer, polystyrene, a butadiene-styrene copolymer and the like. As a matter of course, copolymers are also involved. It is preferred to use a binder having a composition containing polyvinyl butyral in an amount of from 50 to 100% by weight.

The total amount of the binder in the invention is such an amount that is sufficient to retain the components therein. In other words, it is used in such a range that is effective to function as a binder. The effective range can be appropriately determined by a skilled person in the art. As a standard for retaining at least the organic silver salt, the ratio of the binder to the organic silver salt is preferably from 15/1 to 1/3, and particularly preferably from 8/1 to 1/2, in terms of weight ratio.

The photothermographic material of the invention, a phenol derivative represented by the formula (A) disclosed in JP-A-2000-267222 is preferably used as a development accelerator.

In the photothermographic material, a toning agent is preferably added, and the toning agent is disclosed in paragraphs 0054 to 0055 of JP-A-10-62899, page 21, lines 23 to 48 of EP 0,803764 A1, and Japanese Patent Application No. 10-213487. In particular, a phthalazione compound (phthalazinone, a phthalazinone derivative or a metallic salt thereof; for example, 4-(1-naphthyl)phthalazinone, 6-chlorophthalazinone, 5,7-dimethoxyphthalazinone and 2,3-dihydro-1,4-phthalazinedione); a combination of a phthalazinone compound and a phthalic acid compound (for example, phthalic acid, 4-methylphthalic acid, 4-nitrophthalic acid and tetrachlorophthalic anhydride); a phthalazine compound (for example, phthalazine, a phthalazine derivative or a metallic salt thereof; for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine); and a combination of a phthalazine compound and a phthalic acid compound are preferred, and in particular, a combination of a phthalazine compound and a phthalic acid compound is preferred.

The toning agent is preferably contained in the image forming layer (photosensitive layer) in an amount of from 0.1 to 0.5 mole, and more preferably from 0.2 to 0.5 mole, per 1 mole of silver.

The silver halide emulsion and/or the organic silver salt used in the invention may be further protected from formation of additional fogging by a fogging preventing agent, a stabilizer and a stabilizer precursor, whereby it can be stabilized to reduction of sensitivity during stock preservation. The fogging preventing agent, the stabilizer and the stabilizer precursor that can be suitably used solely or in combination include thiazonium salts disclosed in U.S. Pat. No. 2,131,038 and U.S. Pat. No. 2,694,716, azaindenes disclosed in U.S. Pat. No. 2,886,437 and U.S. Pat. No. 2,444,605, compounds disclosed in JP-A-9-329865 and U.S. Pat. No. 6,083,681, mercury salts disclosed in U.S. Pat. No. 2,728,663, urazols disclosed in U.S. Pat. No. 3,287,135, sulfocatechols disclosed in U.S. Pat. No. 3,235,652, oximes, nitrones and nitroindazoles disclosed in British Patent No. 623,448, polyvalent metallic salts disclosed in U.S. Pat. No. 2,839,405, thiuronium salts disclosed in U.S. Pat. No. 3,220,839, palladium, platinum and gold salts disclosed in U.S. Pat. No. 2,566,263 and U.S. Pat. No. 2,597,915, halogen-substituted organic compounds disclosed in U.S. Pat. No. 4,108,665 and U.S. Pat. No. 4,442,202, triazines disclosed in U.S. Pat. No. 4,128,557, U.S. Pat. No. 4,137,079, U.S. Pat. No. 4,138,365 and U.S. Pat. No. 4,459,350, phosphorous compounds disclosed in U.S. Pat. No. 4,411,985, and the like.

The fogging preventing agent that is preferably used in the invention includes organic halogen compounds, and among these, a polyhalomethyl compound, and particularly a trihalomethylsulfone compound, are preferred. Examples of the organic halogen compounds include those disclosed, for example, in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, JP-A-9-160167, JP-A-9-244177, JP-A-9-244178, JP-A-9-258367, JP-A-9-256150, JP-A-9-319022, JP-A-10-171063, JP-A-11-212211, JP-A-11-231460, JP-A-11-242304, U.S. Pat. No. 5,340,712, U.S. Pat. No. 5,369,000, and U.S. Pat. No. 5,464,737, and specifically, 2-(tribromomethylsulfone) quinoline, 2-(tribromomethylsolfuone)pyridine, tribromomethylphenylsulfone, tribromomethylnaphthylsulfone and the like are exemplified.

There are some cases where a mercury(II) salt is advantageously added to the photosensitive layer as a fogging preventing agent while it is not a necessary component of the photothermographic material of the invention. Such a mercury(II) salt that is preferred for the purpose includes mercury acetate and mercury bromide. The addition amount of mercury is preferably from 1 nanomole (nmol) to 1 millimole (μmol), and more preferably from 10 nanomole (nmol) to 100 micromole (μmol), per 1 mole of coated solver.

The photothermographic material of the invention may contain a benzoic acid compound for attaining high sensitivity and fogging prevention. The benzoic acid compound used in the invention may be any benzoic acid derivative, and examples of preferred structures include compounds disclosed in U.S. Pat. No. 4,784,939, U.S. Pat. No. 4,152,160, JP-A-9-281637, JP-A-9-329864, JP-A-329865 and the like.

While the benzoic acid compound used in the invention may be added any location of the photothermographic material, it is preferably added to a layer on the surface having the photosensitive layer thereon, and is more preferably added to a layer containing the organic silver salt. The stage where the benzoic acid compound is added may be any step during the preparation of coating compositions. In the case where it is added to the organic silver salt-containing layer, it may be added in any step from the preparation of the organic silver salt to the preparation of the coating composition, and it is preferably added in a step after the preparation of the organic silver salt to a step immediately before coating.

The addition method of the benzoic acid compound may be any method including power, solutions, fine particle dispersions and the like. It may also be added as a solution formed by mixing with other additives, such as the sensitizing dye, the reducing agent, the toning agent and the like. The addition amount of the benzoic acid compound may be any amount, and it is preferably from 1 micromole (μmol) to 2 mole (mol), and more preferably from 1 millimole (mmol) to 0.5 mole (mol), per 1 mole of silver.

A mercapto compound, a disulfide compound and a thionic compound may be contained in the invention in order to suppress or accelerate development to control development, to improve the spectral sensitization efficiency, to improve the storage stability before and after development and the like purposes.

In the case where a mercapto compound is used in the invention, one having any structure can be used, and those represented by Ar—SM and Ar—S—S—Ar are preferred. In the formulae, M represents a hydrogen atom or an alkali metal atom, and Ar represents an aromatic ring or a condensed aromatic ring having one or more of a nitrogen, sulfur, oxygen, selenium or tellurium atom. What is preferred is a heterocyclic aromatic ring, such as benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazoline. The heterocyclic aromatic ring may have one selected from, for example, a substituent group consisting of halogen (such as Br and Cl), hydroxyl, amino, carboxyl, alkyl (such as those having one or more carbon atom, preferably those having from 1 to 4 carbon atoms) and alkoxy (such as those having one or more carbon atom, preferably those having from 1 to 4 carbon atoms) Examples of the mercapto-substituted heterocyclic aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(bezothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazoline, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 2-mercapto-4-phenyloxazole and the like, but the invention is not limited to them.

The addition amount of the mercapto compound is preferably in a range of from 0.001 to 1.0 mole per 1 mole of silver in the photosensitive layer, and more preferably from 0.01 to 0.3 mole per 1 mole of silver.

A plasticizer and a lubricating agent that can be used in the photosensitive layer of the invention are disclosed in paragraph 0117 of JP-A-11-65021, a super high contrast agent for forming an image having super high contrast and a addition method therefor are disclosed in paragraph 0118 of the same publication, paragraphs 0136 to 0193 of JP-A-11-223898, compounds of the formula (H), the formulae (1) to (3) and the formulae (A) and (B) of Japanese Patent Application No. 11-87297, and compounds of the formulae (III) to (V) (specific compounds of (kagaku 21) to (kagaku 24)) of Japanese Patent Application No. 11-91652, a high contrast accelerator is disclosed in paragraph 0102 of JP-A-11-65021 and paragraphs 0194 to 0195 of JP-A-11-223898.

In the photosensitive silver halide-containing layer (photosensitive layer) in the invention, the absorption (absorbance) at the exposure wavelength is preferably from 0.1 to 0.6, and more preferably from 0.2 to 0.5. When the absorption is large, Dmin is increased to make the image difficult to be distinguished, and when the absorption is small, sharpness is impaired. Absorption may be endowed to the photosensitive layer of the invention by any method, and a dye is preferably used. The dye may be any one as far as it satisfies the absorption conditions shown in the foregoing, and examples thereof include a pyrazoloazole dye, an anthraquinone dye, an azo dye, an azomethine dye, an oxonole dye, a carbocyanine dye, a styryl dye, a triphenylmethane dye, an indoaniline dye, an indophenol dye, a squalirium dye and the like. The dye that can be preferably used in the invention includes an anthraquinone dye (such as compounds 1 to 9 disclosed in JP-A-5-341441, compounds 3–6 to 3–18 and 3–23 to 3–38 disclosed in JP-A-5-165147 and the like), an azomethine dye (such as compounds 17 to 47 disclosed in JP-A-5-341441 and the like), an indoaniline dye (such as compounds 11 to 19disclosed in JP-A-5-289227, compound 47 disclosed in JP-A-5-341441, compounds 2–10 to 2–11 disclosed in JP-A-5-165147 and the like), an azo dye (such as compounds 10 to 16 disclosed in JP-A-5-341441) and a squalirium dye (such as compounds 1 to 20 disclosed in JP-A-10-104779 and compounds 1a to 3d disclosed in U.S. Pat. No. 5,380,635).

The addition method of the dyes may be any method, for example, a solution, an emulsion, a solid fine particle dispersion, such a state that is mordanted on a polymer dye mordant. The using amount of the compounds is determined by the objective absorption amount, and in general, it is preferably used in a range of from 1 μm to 1 g per 1 $m^2$.

In the invention, some parts other than the photosensitive layer preferably has an absorption at the exposure wavelength of from 0.1 to 3.0, and more preferably from 0.3 to 2.0, from the standpoint of prevention of halation. The parts having such an absorption at the exposure wavelength is preferably a layer on the surface opposite to the photosensitive layer with respect to the support (such as a backing layer, a ground coating or undercoating layer on the back surface, and a protective layer of the backing layer) or a layer between the photosensitive layer and the support (such as a ground coating or a undercoating layer).

In the case where the photosensitive silver halide is spectrally sensitized to the infrared region, it is preferred that the absorption maximum in the visible region is 0.3 or less, while absorption is endowed to the parts other than the photosensitive layer. As a dye used for coloring, the same ones as the dyes that can be used for endowing absorption to the photosensitive silver halide layer, and it may be the same as or different from the dye used in the photosensitive silver halide layer.

In the case where the photosensitive silver halide is spectrally sensitized to the visible region, it is preferred to use a dye extinguished by a heat treatment or a combination of a compound extinguished and a dye extinguished by a heat treatment in the parts other than the photosensitive layer. Examples of the colored layer that is extinguished include the following, but the invention is not limited to them. The examples are disclosed in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734, U.S. Pat. No. 4,088,497, U.S. Pat. No. 4,283,487, U.S. Pat. No. 4,548,896 and U.S. Pat. No. 5,187,049. The using amount of the compounds is determined by the absorption amount, and in general, it is preferably used in a range of from 1 μm to 1 g per 1 $m^2$.

The photothermographic material of the invention may be provided with a surface protective layer for such a purpose as prevention of adhesion of the photosensitive layer. As a binder of the surface protective layer, any polymer may be used. Examples of the binder include polyester, gelatin, polyvinyl alcohol, a cellulose derivative, and a cellulose derivative is preferred. Examples of the cellulose derivative will be shown below, but it is not limited to them. Examples include cellulose acetate, cellulose acetate butyrate, cellulose propionate, hydroxypropyl cellulose, hydroxypropylmethyl cellulose, methyl cellulose, hydroxyethyl cellulose, carboxymethyl cellulose and the like, as well as mixtures thereof.

The thickness of the surface protective layer in the invention is preferably from 0.1 to 10 μm, and particularly preferably from 1 to 5 μm.

As the surface protective layer, any adhesion preventing material may be used. Examples of the adhesion preventing material include wax, liquid paraffin, silica particles, a styrene-containing elastomer block copolymer (such as styrene-butadiene-styrene and styrene-isoprene-styrene), cellulose acetate, cellulose acetate butyrate, cellulose propionate and mixtures thereof.

In the photosensitive layer and the protective layer for the photosensitive layer in the invention, a light absorbing substance and a filter dye disclosed in U.S. Pat. No. 3,253,921, U.S. Pat. No. 2,274,782, U.S. Pat. No. 2,527,583 and U.S. Pat. No. 2,956,879 may be used. They may also be mordanted with a dye as disclosed in U.S. Pat. No. 3,282,699. The using amount of the filter dye is preferably such an amount that the absorbance at the exposure wavelength is from 0.1 to 3.0, and particularly preferably such an amount that it is from 0.2 to 1.5.

In the photosensitive layer and the protective layer for the photosensitive layer in the invention, a matting agent, such as starch, titanium dioxide, zinc oxide, silica, polymer beads containing beads of the species disclosed in U.S. Pat. No. 2,992,101 and U.S. Pat. No. 2,701,245 and the like, may be contained. The matt degree of the emulsion surface may be any degree as far as so-called stardust failure does not occur, in which small white dots occurs to cause light leakage, it is preferably from 200 to 10,000 seconds, and particularly preferably from 300 to 10,000 seconds, in terms of Beck's smoothness.

In the photothermographic material of the invention, the photosensitive layer is constituted with one or more layers on a support. In the case of one-layer constitution, it contains the organic silver salt, the silver halide, the reducing agent and the binder, as well as additional materials depending on necessity, such as the toning agent, a coating assistant, other auxiliary agents and the like. In the case of two-layer constitution, the organic silver salt and the silver halide are contained in a first photosensitive layer (in general, a layer adjacent to the base material), and some other components are contained in a second layer or in both layers. Such a two-layer constitution is possible that contains a single photosensitive layer containing all the components and a protective top coating layer. In the constitution of a multi-color photosensitive thermal development photographic material, these two layers may be contained for the respective colors, or in alternative, all the component may be contained in a single layer as disclosed in U.S. Pat. No. 4,708,928. In the case of a multi-dye multi-color photosensitive thermal development photographic material, in general, the respective photosensitive layers are maintained with separation from each other by using a functional or non-functional barrier layer among the respective photosensitive layers as disclosed in U.S. Pat. No. 4,460,681.

The thermal development photosensitive in the invention is preferably a so-called single sided photosensitive material, which has least one photosensitive layer containing a silver halide emulsion on one surface of the support, and has a backing layer on the other surface.

A matting agent may be added to the photothermographic material of the invention for improvement of conveying property. The matting agent is generally fine particles of a water insoluble organic or inorganic compound. Arbitrary matting agents may be used, and those that have been well known in this field of art may be used, such as organic matting agent disclosed in U.S. Pat. No. 1,939,213, U.S. Pat. No. 2,701,245, U.S. Pat. No. 2,322,037, U.S. Pat. No. 3,262,782, U.S. Pat. No. 3,539,344, U.S. Pat. No. 3,767,448 and the like, and inorganic matting agents disclosed in U.S. Pat. No. 1,260,772, U.S. Pat. No. 2,192241, U.S. Pat. No. 3,257,206, U.S. Pat. No. 3,370,951, U.S. Pat. No. 3,523,022, U.S. Pat. No. 3,769,020 and the like.

Specifically, as examples of organic compounds that can be used as the matting agent, a water dispersible vinyl polymer, such as polymethyl acrylate, polymethyl methacrylate, polyacrylonitrile, an acrylonitrile-α-methylstyrene copolymer, polystyrene, a styrene-divinylbenzene copolymer, polyvinyl acetate, polyethylene carbonate, polytetrafluoroethylene and the like; a cellulose derivative, such as methylcellulose, cellulose acetate, cellulose acetate propionate and the like; a starch derivative, such as carboxyl starch, carboxynitrophenyl starch, a urea-formaldehyde-starch reaction product and the like; gelatin having been hardened with a known hardening agent and hardened gelatin formed into microcapsule hollow particles by coacervate hardening; and the like can be preferably used.

As examples of the inorganic compound, silicon dioxide, titanium dioxide, magnesium dioxide, aluminum oxide, barium sulfate, calcium carbonate, silver chloride having been desensitized by a known method, the similarly desensitized silver bromide, glass, diatom earth and the like can be preferably used.

The matt agents may be used after mixing different kinds of substances depending on necessity.

The size and the shape of the matting agent are not particularly limited, and those having an arbitrary particle diameter may be used. Among these, those having a particle diameter of from 0.1 to 30 μm are preferably used.

The particle diameter distribution of the matting agent may be either narrow or broad.

Because the matting agent has a great influence on the haze and the surface gloss of the photothermographic material, it is preferred that the particle diameter, the shape and the particle diameter distribution thereof are adjusted to the necessary conditions on producing the matting agent or mixing plural kinds of matting agents.

In the invention, examples of the layer that can contain the matting agent include the outermost layers of the photosensitive layer side and the back side (which may be the photosensitive layer and the backing layer), the protective layer, the ground coating layer and the like. In short, it is preferably contained in the outermost surface layer or a layer functioning as the outermost surface layer, or a layer in the vicinity of the outer surface. Therefore, it is also preferably contained in a layer functioning as a so-called protective layer.

In the invention, the matt degree of the back surface is preferably from 10 to 250 seconds, and more preferably from 50 to 180 seconds, in terms of Beck's smoothness.

As the binder of the photosensitive layer, any polymer may be used, and in general, a natural resin, polymer and copolymer, a synthetic resin, polymer and copolymer, and other media that form films, which are colorless, are exemplified. Examples thereof include gelatin compounds, rubber compounds, poly (vinyl alcohol) compounds, hydroxyethyl cellulose compounds, cellulose acetate compounds, cellulose acetate butyrate compounds, poly(vinyl pyrrolidone) compounds, casein, starch, poly(acrylic acid) compound, poly(methylmethacrylic acid) compounds, poly(vinyl chloride) compounds, poly(methacrylic acid) compounds, styrene-maleic anhydride copolymers, styrene-acrylonitrile copolymers, styrene-butadiene copolymers, poly(vinylacetal) compound (such as poly(vinylformal) and poly(vinylbutyral)), polyester compounds, polyurethane compounds, phenoxy resins, poly(vinylidene chloride) compounds, polyepoxide compounds, polycarbonate compounds, poly(vinyl acetate) compounds, polyolefin compounds, cellulose ester compounds and polyamide compounds. The binder maybe formed in to a film from water, an organic solvent or an emulsion.

In the invention, the glass transition temperature of the binder contained in the photosensitive layer is 45° C. or higher, preferably from 45 to 100° C., more preferably from 50 to 80° C., and further preferably from 60 to 70° C.

In this specification, Tg is calculated from the following equation.

$$1/Tg=\Sigma(Xi/Tgi)$$

Herein, it is assumed that the polymer is formed by copolymerizing n monomers, i.e., i=1 to n. Xi shows the weight fraction of the i-th monomer ($\Sigma Xi=1$), and Tgi shows the glass transition temperature (absolute temperature) of a homopolymer of the i-th monomer. $\Sigma$ means the sum of i=1 to n. As the values of glass transition temperatures (Tgi) of homopolymers of the respective monomers, the values in Polymer Handbook (3rd Edition) (by J. Brandrup and E. H. Immergut (Wiley-Interscience (1989)).

The binder may be used in combination of two or more kinds thereof. A polymer binders having different glass transition temperatures may be used in combination. In the case where two or more kinds of polymers, which are different in Tg, are used by mixing, it is preferred that the weight average Tg thereof is in the foregoing range.

A backside resistive heating layer shown in U.S. Pat. No. 4,460,681 and U.S. Pat. No. 4,374,921 may be provided on the photothermographic material of the invention.

A film hardening agent may be used in the respective layers, such as the photosensitive layer, the protective layer, the backing layer and the like, in the invention. As examples of the film hardening agent, polyisocyanate compounds disclosed in U.S. Pat. No. 4,281,060, JP-A-6-208193 and the like, epoxy compounds disclosed in U.S. Pat. No. 4,791,042 and the like, vinylsulfone compounds disclosed in JP-A-62-89048 and the like, and the like.

In the invention, a surface active agent may be used for improvement of coating property and electric charge. As examples of the surface active agent, any kind thereof including nonionic, anionic, cationic, fluorine and the like may be appropriately used. Specific examples thereof include fluorine polymer surface active agents disclosed in JP-A-62-170950, U.S. Pat. No. 5,380,644 and the like, fluorine surface active agents disclosed in JP-A-60-244945, JP-A-63-188135 and the like, polysiloxane surface active agents disclosed in U.S. Pat. No. 3,885,965 and the like, polyalkyleneoxides and anionic surface active agents disclosed in JP-A-6-301140 and the like, and the like.

As examples of a solvent used in a coating composition for forming the respective layers constituting the photothermographic material in the invention, those shown in New Solvent Pocket Book (Ohmsha, Ltd. (1994)), but the invention is not limited to them. The boiling point of the solvent used in the invention is preferably from 40 to 180° C.

Specific examples of the solvent used in the invention include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutylether, anisole, ethylene glycol diethyl ether, N,N-dimethylformamide, morpholine, propanesultone, perfluorotributylamine, water and the like.

The photosensitive layer in the invention may be coated on various kinds of supports. Typical examples of the support include a polyester film, an undercoated polyester film, a poly(ethylene terephthalate) film, a poly(ethylenenaphthalate) film, a cellulose nitrate film, a cellulose ester film, a polyvinylacetal film, a polycarbonate film and related or resinous material, with glass, paper, metals being included. A flexible base material, particularly a paper support coated with a partially acetylated, or baryta and/or an α-olefin polymer, particularly a polymer of an α-olefin having from 2 to 10 carbon atoms, such as polyethylene, polypropylene, an ethylene-butene copolymer and the like, is typically used. The support may be either transparent or opaque, and is preferably transparent.

The photothermographic material of the invention may have a charge preventing or electroconductive layer, for example, a soluble salt (such as a chloride, a nitrate and the like), a vapor-deposited metallic layer, a layer containing an ionic polymer disclosed in U.S. Pat. No. 2,861,056 and U.S. Pat. No. 3,206,312 or an insoluble inorganic salt disclosed in U.S. Pat. No. 3,428,451.

A color image can be obtained by using the photothermographic material of the invention, and examples of a method therefor include such a method that is disclosed in page 10, left column, line 43 to page 11, left column, line40 of JP-A-7-13295. As a stabilizer for a color dye image, those disclosed in British Patent No. 1,326,889, U.S. Pat. No. 3,432,300, U.S. Pat. No. 3,698,909, U.S. Pat. No. 3,574,627, U.S. Pat. No. 3,573,050, U.S. Pat. No. 3,764,337 and U.S. Pat. No. 4,042,394 can be used.

The thermal development photographic emulsion in the invention can be coated by various kinds of coating operations including dip coating, air knife coating, flow coating and extrusion coating using a kind of a hopper disclosed in U.S. Pat. No. 2,681,294. Two layer or more than two layers may be simultaneously coated by the methods disclosed in U.S. Pat. No. 2,761,791 and British Patent No. 837,095.

In the photothermographic material of the invention, additional layers may be included, for example, a dye receiving layer for receiving a movable dye image, an opacifying layer in the case where reflection printing is demanded, a protective top coating layer, a primer layer known in the photothermal photographic technique, and the like may be contained. It is preferred that the photothermographic material of the invention can conduct image formation by the photothermographic material itself only, and it is preferred that no waste material occurs other than the image sheet thus formed.

The photothermographic material of the invention may be developed in any method, and in general, the photothermographic material having been image wise exposed is heated to be developed. The developing temperature is preferably from 80 to 250° C., and more preferably from 100 to 140° C. The developing time is preferably from 1 to 180 seconds, and more preferably from 10 to 90 seconds.

The developing method is not particularly limited and may be a method using a heat drum, a method using a panel heater and the like, and it is preferred that the development is carried out by using a heat drum.

The photothermographic material of the invention may be exposed in any method, and laser light is preferred as an exposure light source. As the laser light in the invention, a gas laser, a dye laser, a semiconductor laser and the like are preferred. A semiconductor laser and a YAG laser may be used with a secondary harmonic wave generating device.

EXAMPLES

The invention will be specifically described based on examples below, but the invention is not limited to the examples.

Example 1

(Preparation of Photosensitive Silver Halide Emulsion 1)

4.3 ml of a 1% by weight potassium iodide solution was added to 1,420 ml of distilled water, and 3.5 ml of sulfuric acid having a concentration of 0.5 mol/L and 36.7 g of phthalated gelatin were added thereto to form a solution. The solution was maintained at a liquid temperature of 42° C. in a stainless steel reaction vessel under stirring, and the whole of a solution A formed by diluting by adding distilled water to 22.22 g of silver nitrate to make 195.6 ml and a solution B formed by diluting 21.8 g of potassium iodide with distilled water to a volume of 218 ml were added thereto at a constant flow amount over 9 minutes. Thereafter, 10 ml of a 3.5% by weight aqueous solution of hydrogen peroxide was added, and 10.8 ml of a 10% by weight aqueous solution of benzimidazole was further added. Furthermore, a solution C is formed by diluting by adding distilled water to 51.86 g of silver nitrate to make 317.5 ml, and a solution D is formed by diluting 60 g of potassium iodide with distilled water to a volume of 600 ml. The whole of the solution C was added at a constant flow amount over 120 minutes, and the solution D was added by the controlled double jet method with pAg being maintained at 8.1. The whole of potassium tetrachloroiridate(III) in an amount of $1\times10^{-4}$ mole per 1 mole of silver was added 10 minutes after the start of addition of the solution C and the solution D. The whole of an aqueous solution of potassium iron(II) tetracyanide in an amount of $3\times10^{-4}$ mole per 1 mole of silver was added 5 seconds after the completion of the addition of the solution C. The pH was adjusted to 3.8 by using sulfuric acid having a concentration of 0.5 mol/L, stirring was terminated, and then sedimentation, desaltation and water washing steps were carried out. The pH was adjusted to 5.9 by using sodium hydroxide of a concentration of 1 mol/L to form a silver halide dispersion of pAg 8.0.

The silver halide dispersion was maintained at 38° C. under stirring, to which 5 ml of a 0.34% by weight methanol solution of 1,2-benzoisothiazolin-3-one was added, and the temperature was increased to 47° C. After lapsing 20 minutes from the temperature increase, sodium benzenethiosulfonate was added in the form of a methanol solution in an amount of $7.6\times10^{-5}$ mole per 1 mole of silver, and further 5 minutes after, the following tellurium sensitizing agent B was added in the form of a methanol solution in an amount of $2.9\times10^{-4}$ mole per 1 mole of silver, followed by aging for 91 minutes. 1.3 ml of a 0.8% by weight methanol solution of N,N'-dihydroxy-N"-diethylmelamine was added, and 4 minutes after, 5-methyl-2-mercaptobenzimidazole in the form of a methanol solution in an amount of $4.8\times10^{-3}$ mole per 1 mole of silver and 1-phenyl-2-heptyl-5-mercapto-1,3,4-triazole in the form of a methanol solution in an amount of $5.4\times10^{-3}$ mole per 1 mole of silver were added to prepare a silver halide emulsion 1.

The particles of the silver halide emulsion 1 thus prepared were pure silver iodide particles having an average sphere-equivalent diameter of 0.040 μm and a variation coefficient of sphere-equivalent diameter of 18%. The particle size and the like were obtained from the average of 1,000 particles by using an electron microscope.

(Preparation of Photosensitive Silver Halide Emulsion 2)

A silver halide emulsion 2 having a composition of a silver iodide content in the silver halide of 3.5% by mole was prepared in the same manner as in the preparation of the photosensitive silver halide 1 except that the amount of potassium iodide added upon preparation of the silver halide dispersion was changed, and the temperature upon growth of particles was controlled for size adjustment.

The particle size of silver halide of the emulsion was adjusted to an average sphere-equivalent diameter of 0.04 μm by changing the temperature upon forming the particles.

(Preparation of Photosensitive Silver Halide Emulsion 3)

3.1 ml of a 1% by weight potassium iodide solution was added to 1,421 ml of distilled water, and 3.5 ml of sulfuric acid having a concentration of 0.5 mol/L and 31.7 g of phthalated gelatin were added thereto to form a solution. The solution was maintained at a liquid temperature of 32° C. in a stainless steel reaction vessel under stirring, and the whole of a solution A formed by diluting by adding distilled water to 22.22 g of silver nitrate to make 95.4 ml and a solution B formed by diluting 15.3 g of potassium bromide and 0.8 g of potassium iodide with distilled water to a volume of 97.4 ml were added thereto at a constant flow amount over 45 seconds. Thereafter, 10 ml of a 3.5% by weight aqueous solution of hydrogen peroxide was added, and 10.8 ml of a 10% by weight aqueous solution of benzimidazole was further added. Furthermore, a solution C is formed by diluting by adding distilled water to 30.64 g of silver nitrate to make 187.6 ml, and a solution D is formed by diluting 44.2 g of potassium bromide and 2.2 g of potassium iodide with distilled water to a volume of 400 ml. The whole of the solution C was added at a constant flow amount over 12 minutes, and the solution D was added by the controlled double jet method with pAg being maintained at 8.1. Thereafter, a solution E formed by adding 130 ml of distilled water to 22.2 g of silver nitrate and a solution F formed by diluting 21.7 g of potassium iodide with distilled water to a volume of 217 ml were added by the controlled double jet method with the pAg being maintained at 6.3. The whole of potassium tetrachloroiridate(III) in an amount of $1\times10^{-4}$ mole per 1 mole of silver was added 10 minutes after the start of addition of the solution C and the solution D. The whole of an aqueous solution of potassium iron(II) tetracyanide in an amount of $3\times10^{-4}$ mole per 1 mole of silver was added 5 seconds after the completion of the addition of the solution C. The pH was adjusted to 3.8 by using sulfuric acid having a concentration of 0.5 mol/L, stirring was terminated, and then sedimentation, desaltation and water washing steps were carried out. The pH was adjusted to 5.9 by using sodium hydroxide of a concentration of 1 mol/L to form a silver halide dispersion of pAg 8.0.

The silver halide dispersion was maintained at 38° C. under stirring, to which 5 ml of a 0.34% by weight methanol solution of 1,2-benzoisothiazolin-3-one was added, and 1 minute after, the temperature was increased to 47° C. After lapsing 20 minutes from the temperature increase, sodium benzenethiosulfonate was added in the form of a methanol solution in an amount of $7.6\times10^{-5}$ mole per 1 mole of silver, and further 5 minutes after, the following tellurium sensitizing agent B was added in the form of a methanol solution in an amount of $2.9\times10^{-4}$ mole per 1 mole of silver, followed by aging for 91 minutes. 1.3 ml of a 0.8% by weight methanol solution of N,N'-dihydroxy-N"-diethylmelamine was added, and 4 minutes after, 5-methyl-2-mercaptobenzimidazole in the form of a methanol solution in an amount of $4.8\times10^{-3}$ mole per 1 mole of silver and 1-phenyl-2-heptyl-5-mercapto-1,3,4-triazole in the form of a methanol solution in an amount of $5.4\times10^{-3}$ mole per 1 mole of silver were added to prepare a silver halide emulsion 3.

The particles of the silver halide emulsion thus prepared were particles formed by joining 70% by mole of a silver bromide layer and 30% by mole of a silver iodide layer having an average sphere-equivalent diameter of 0.040 μm and a variation coefficient of sphere-equivalent diameter of 20%. The part having a crystalline structure of a silver iodide structure had light absorption ascribed to the direct transition.

(Preparation of Photosensitive Silver Halide Emulsion 4)

3.1 ml of a 1% by weight potassium iodide solution was added to 1,421 ml of distilled water, and 3.5 ml of sulfuric acid having a concentration of 0.5 mol/L and 31.7 g of phthalated gelatin were added thereto to form a solution. The solution was maintained at a liquid temperature of 34° C. in a stainless steel reaction vessel under stirring, and the whole of a solution A formed by diluting by adding distilled water to 22.22 g of silver nitrate to make 95.4 ml and a solution B formed by diluting 15.3 g of potassium bromide and 0.8 g of potassium iodide with distilled water to a volume of 97.4 ml were added thereto at a constant flow amount over 45 seconds. Thereafter, 10 ml of a 3.5% by weight aqueous solution of hydrogen peroxide was added, and 10.8 ml of a 10% by weight aqueous solution of benzimidazole was further added. Furthermore, a solution C is formed by diluting by adding distilled water to 51.86 g of silver nitrate to make 317.5 ml, and a solution D is formed by diluting 60 g of potassium iodide with distilled water to a volume of 600 ml. The whole of the solution C was added at a constant flow amount over 120 minutes, and the solution D was added by the controlled double jet method with pAg being maintained at 6.3. The whole of potassium tetrachloroiridate(III) in an amount of $1\times10^{-4}$ mole per 1 mole of silver was added 10 minutes after the start of addition of the solution C and the solution D. The whole of an aqueous solution of potassium iron(II) tetracyanide in an amount of $3\times10^{-4}$ mole per 1 mole of silver was added 5 seconds after the completion of the addition of the solution C. The pH was adjusted to 3.8 by using sulfuric acid having a concentration of 0.5 mol/L, stirring was terminated, and then sedimentation, desaltation and water washing steps were carried out. The pH was adjusted to 5.9 by using sodium hydroxide of a concentration of 1 mol/L to form a silver halide dispersion of pAg 8.0.

A silver halide emulsion 4 was prepared in the same manner as in the case of the silver halide emulsion 3 for the other conditions. The particles of the silver halide emulsion thus prepared were particles formed by joining 30% by mole of a silver bromide layer and 70% by mole of a silver iodide layer having an average sphere-equivalent diameter of 0.040 μm and a variation coefficient of sphere-equivalent diameter of 10%. The part having a crystalline structure of a silver iodide structure had light absorption ascribed to the direct transition.

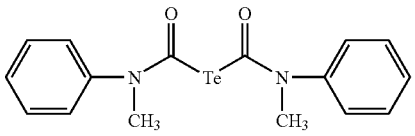

Tellurium Sensitizing Agent B (Preparation of Powder Organic Silver Salts A to D)

Behenic acid, arachidic acid and stearic acid were added to 4,720 ml of pure water in the ratios shown in Table 1 below in a total amount of 0.7552 mole and dissolved at 80° C., and then 540.2 ml of a 1.5 N sodium hydroxide aqueous solution was added. After adding 6.9 ml of concentrated nitric acid, it was cooled to 55° C. to obtain a solution of a sodium salt of an organic acid. While the temperature of the solution of a sodium salt of an organic acid was maintained at 55° C., 45.3 g of the silver halide emulsion and 450 ml of pure water were added thereto, and it was stirred for 5 minutes with a homogenizer (ULTRA-TURRAX T-25), produced by IKA Japan, Co., Ltd., at 13,200 rpm (21.1 KHz as a mechanical vibration frequency). Subsequently, 702.6 ml of a 1 mol/L silver nitrate solution was added over 2 minutes, and it was stirred for 10 minutes to obtain an organic silver salt dispersion. Thereafter, the resulting organic silver salt dispersion was placed in a washing vessel, to which deionized water was added and stirred, and the organic silver salt dispersion was separated by surfacing through still standing, followed by removing water soluble salts in the lower layer. Thereafter, washing with deionized water and drainage were repeated until the electroconductivity of the waste water reached 2 μS/cm, and after conducting centrifugal dehydration, drying was carried out in a circulation dryer with warm air having an oxygen partial pressure shown in Table 1 at 40° C. until reduction of weight was completed, so as to obtain the following powder organic silver salts A to D.

The combinations of the silver halide emulsions used for preparing the powder organic silver salts A to D were those as shown in Table 2.

TABLE 1

| Organic silver salt | Behenic acid (% by mole) | Arachidic acid (% by mole) | Stearic acid (% by mole) | Oxygen partial pressure (% by volume) |
|---|---|---|---|---|
| A | 25 | 55 | 20 | 10 |
| B | 54 | 29 | 17 | 10 |
| C | 60 | 28 | 12 | 10 |
| D | 90 | 10 | 0 | 10 |

(Preparation of Photosensitive Emulsion Dispersion)

14.57 g of polyvinyl butyral powder (Butvar B-79, Monsant Corp., Tg: 67° C.) was dissolved in 1,457 g of methyl ethyl ketone (MEK), and under stirring with a dissolver DISPERMAT Type CA-40, produced by VMA-GETZMANN Corp., 500 g of the powder organic silver salt was added to make a slurry through sufficient mixing. The slurry was dispersed by 2 passes with a pressure homogenizer Type GM-2 produced by SMT Co., Ltd. to prepare a photosensitive emulsion dispersion. At this time, the processing pressure of the first pass was 280 kg/cm$^2$, and the processing pressure of the second pass was 560 kg/cm$^2$.

(Preparation of Photosensitive Layer Coating Compositions 1 to 24)

15.1 g of MEK was added to the photosensitive emulsion dispersion (50 g) and maintained at 21° C. under stirring at 1,000 rpm with a dissolver type homogenizer, and 390 μl of a 10% by weight methanol solution of an associated body of two molecules of N,N-dimethylacetamide, one molecule of oxalic acid and one molecule of bromine was added, followed by stirring for 1 hour. Furthermore, 494 μl of a 10% by weight methanol solution of potassium bromide was added, followed by stirring for 20 minutes. Subsequently, 167 mg of a methanol solution containing 15.9% by weight of dibenzo-18-crown-6 and 4.9% by weight of potassium acetate was added, followed by stirring for 10 minutes, and then 2.6 g of an MEK solution of 18.3% by weight of 2-chlorobenzoic acid, 34.2% by weight of salicylic acid p-toluene sulfonate and 4.5% by weight of 5-methyl-2-mercaptobenzimidazole was added, followed by stirring for 1 hour. Thereafter, the temperature was decreased to 13° C., followed by stirring for further 30 minutes. While maintaining at a temperature of 13° C., 13.31 g of polyvinyl butyral (Butvar B-79, Monsant Corp.) was added, followed by stirring for 30 minutes, and then 1.08 g of a 9.4% by weight tetrachlorophthalic acid solution was added, followed by stirring for 15 minutes. Under continuous stirring, 10.0 g of a reducing agent I-6 of 20% by weight and 1.1% by weight of 4-methylphthalic acid were added, 1.5 g of Desmodur N3300 (aliphatic isocyanate, Mobay Corp.) of 10% by weight was subsequently added, and furthermore 4.27 g of an MEK solution of 7.4% by weight of tribromomethyl-2-azaphenylsulfone and 7.2% by weight of phthalazine was added, so as to obtain photosensitive layer coating compositions 1 to 16.

Furthermore, SBR (-St(75)-Bu(24)-AA(1)-, Tg: 29° C.) was used as the binder instead of the polyvinyl butyral powder (Tg: 67° C.) to obtain photosensitive layer coating compositions 17 to 24.

(Preparation of Surface Protective Layer Coating Composition)

96 g of cellulose acetate butyrate (CAB171-15, Eastman Chemical Corp.), 4.5 g of polymethyl methacrylate (Paraloid A-21, Rohm and Haas Corp.), 1.5 g of 1,3-di(vinylsulfonyl)-2-propanol, 1.0 g of benzotriazole and 1.0 g of a fluorine surface active agent (Surfron KH40, Asahi Glass Co., Ltd.) were added and dissolved in 865 g of MEK under stirring, and then 30 g of a dispersion obtained by dispersing 13.6% by weight of cellulose acetate butyrate (CAB171-15, Eastman Chemical Corp.) and 9% by weight of calcium carbonate (Super-Pflex 200, Speciality Minerals Corp.) in MEK with a dissolver type homogenizer at 8,000 rpm for 30 minutes was added, followed by stirring, so as to prepare a surface protective layer coating composition.

(Production of Support)

A PET film having a thickness of 175 μm having been colored in blue at a density of 0.170 (densitometer PDA-65, Konica Corp.) was subjected on both surfaces thereof to a corona discharge treatment of 8 W/m$^2$·min.

(Back Surface Coating)

84.2 g of cellulose acetate butyrate (CAB381-20, Eastman Chemical Corp.) and 4.5 g of a polyester resin (Vitel PE2200B, Bostic Corp.) were added and dissolved in 830 g of MEK under stirring. To the solution thus obtained through dissolution, 4.5 g of a fluorine surface active agent (Surfron KH40, Asahi Glass Co., Ltd.) and 2.3 g of a fluorine surface active agent (Megafac F120K, Dainippon Ink and Chemicals, Inc.) were added, and the mixture was sufficiently stirred until dissolution. Finally, 75 of silica (Syloid 64X6000, W.T. Grace Corp.) dispersed in methyl ethyl ketone at a concentration of 1% by weight with a dissolver type homogenizer was added and stirred to prepare a coating composition for the back surface.

The coating composition for the back surface was coated on the support to a dry thickness of 3.5 μm with an extruding coater, followed by drying. The drying was carried out by using dry air having a dry temperature of 100° C. and a dew point temperature of 10° C. for 5 minutes.

(Preparation of Photothermographic Materials)

The photosensitive coating compositions 1 to 20 and the surface protective layer coating composition were coated with an extruding coater by simultaneous multi-layer coating on the support having been coated on the back surface thereof, whereby photothermographic materials 1 to 24 were produced. The coating was carried out to make a coated silver amount of the photosensitive layer of 1.9 g/m2 and a dry thickness of the surface protective layer of 2.5 μm. Thereafter, it was dried by using dry air having a dry temperature of 75° C. and a dew point temperature of 10° C. for 10 minutes.

(Exposure and Development Process)

The resulting photothermographic materials 1 to 24 were subjected to an exposure treatment in the following manner.

A semiconductor laser NLHV 3000E of Nichia Corp. was implemented as a semiconductor laser light source, and the light amount of the laser light was changed in a range of from 1 to 1,000 mW/mm$^2$ to carry out exposure of the photothermographic material. The emission wavelength of the laser light was 405 nm.

Thereafter, thermal development was carried out at 124° C. for 15 seconds by using an automatic developing machine having a heat drum through contacting the protective layer of the photothermographic material with the surface of the drum, and the resulting image was evaluated by a densitometer. The room where the exposure and the development were carried out herein was of 23° C. and 50% RH.

(Evaluation of Photographic Performance)

The resulting image was measured for density with a densitometer, and a characteristic curve of the density with respect to logarithm of the exposure amount was prepared. The optical density on the non-exposed part was designated as fogging, and the reciprocal of the exposure amount providing an optical density of 3.0 is designated as a sensitivity, which was expressed in terms of a relative value with the sensitivity of the photothermographic material 9 being designated as 100. The results obtained are shown in Table 2.

(Evaluation of Printout Performance)

The photothermographic material after subjecting to the development treatment was placed in a room at 25° C. and 70% RH and allowed to stand under 200 lux with fluorescent lamps for 20 days. The difference of the fogging density after allowing to stand for 30 days under the foregoing conditions from the fogging density immediately after the development treatment was designated as print out. It is preferred that the increase of fogging is smaller even upon stand in a under the foregoing conditions.

The evaluation results are shown in Table 2.

TABLE 2

| Photothermo-graphic material | Silver halide emulsion (AgI content) | Aliphatic silver salt (behenic acid content) | Binder (Tg) | Sensitivity | Fogging | Printout | Note |
|---|---|---|---|---|---|---|---|
| 1 | 1 (100% by mole) | A (25% by mole) | PVB (67° C.) | 110 | 0.45 | 0.03 | comparison |
| 2 | 2 (3.5% by mole) | A (25% by mole) | PVB (67° C.) | 45 | 0.84 | 0.2 | " |
| 3 | 3 (30% by mole) | A (25% by mole) | PVB (67° C.) | 55 | 0.6 | 0.13 | " |
| 4 | 4 (70% by mole) | A (25% by mole) | PVB (67° C.) | 95 | 0.45 | 0.07 | " |
| 5 | 1 (100% by mole) | B (54% by mole) | PVB (67° C.) | 105 | 0.22 | 0 | invention |
| 6 | 2 (3.5% by mole) | B (54% by mole) | PVB (67° C.) | 40 | 0.42 | 0.16 | comparison |
| 7 | 3 (30% by mole) | B (54% by mole) | PVB (67° C.) | 50 | 0.3 | 0.09 | invention |
| 8 | 4 (70% by mole) | B (54% by mole) | PVB (67° C.) | 90 | 0.27 | 0.06 | " |
| 9 | 1 (100% by mole) | C (60% by mole) | PVB (67° C.) | 100 | 0.2 | 0 | " |
| 10 | 2 (3.5% by mole) | C (60% by mole) | PVB (67° C.) | 30 | 0.38 | 0.15 | comparison |
| 11 | 3 (30% by mole) | C (60% by mole) | PVB (67° C.) | 45 | 0.28 | 0.08 | invention |
| 12 | 4 (70% by mole) | C (60% by mole) | PVB (67° C.) | 85 | 0.25 | 0.05 | " |
| 13 | 1 (100% by mole) | D (90% by mole) | PVB (67° C.) | 65 | 0.18 | 0 | comparison |
| 14 | 2 (3.5% by mole) | D (90% by mole) | PVB (67° C.) | 15 | 0.26 | 0.14 | " |
| 15 | 3 (30% by mole) | D (90% by mole) | PVB (67° C.) | 25 | 0.24 | 0.07 | " |
| 16 | 4 (70% by mole) | D (90% by mole) | PVB (67° C.) | 40 | 0.17 | 0.04 | " |
| 17 | 1 (100% by mole) | B (54% by mole) | SBR (29° C.) | 120 | 0.6 | 0.04 | " |
| 18 | 2 (3.5% by mole) | B (54% by mole) | SBR (29° C.) | 50 | 1.15 | 0.45 | " |
| 19 | 3 (30% by mole) | B (54% by mole) | SBR (29° C.) | 65 | 0.83 | 0.25 | " |
| 20 | 4 (70% by mole) | B (54% by mole) | SBR (29° C.) | 100 | 0.7 | 0.13 | " |
| 21 | 1 (100% by mole) | C (60% by mole) | SBR (29° C.) | 115 | 0.58 | 0.04 | " |
| 22 | 2 (3.5% by mole) | C (60% by mole) | SBR (29° C.) | 45 | 1.06 | 0.43 | " |
| 23 | 3 (30% by mole) | C (60% by mole) | SBR (29° C.) | 60 | 0.78 | 0.24 | " |
| 24 | 4 (70% by mole) | C (60% by mole) | SBR (29° C.) | 95 | 0.61 | 0.13 | " |

It is clear from Table 2 that it is understood that the photothermographic materials of the invention exhibit low fogging and are excellent in printout performance.

EFFECT OF THE INVENTION

The photothermographic material and the process for forming an image according to the invention use a silver halide containing silver iodide in a high concentration (a high silver iodide silver halide) as a photosensitive silver halide, is excellent in image storage stability after the developing treatment, and provide an image of high sensitivity and high image quality.

This application is based on Japanese Patent application JP 2001-309951, filed Oct. 5, 2001, the entire content of which is hereby incorporated by reference, the same as if set forth at length.

What is claimed is:

1. A process for forming an image, the process comprising:

exposing the photothermographic material to a light having a peak intensity at a wavelength of from 350 nm to 440 nm and an illuminance of 1 mW/mm$^2$ or more; and subjecting the material to a thermal development after the exposing, wherein the photothermographic material comprises a transparent support; and a photosensitive layer comprising a photosensitive silver halide, a non-photosensitive organic silver salt, a thermal developer and a binder, wherein the photosensitive silver halide comprises silver iodide in a ratio of 5% by mole or more, the non-photosensitive organic silver salt comprises silver behenate in a ratio of 30% by mole or more and less than 80% by mole, and the binder has a glass transition temperature of 45° C. or more.

2. The process for forming an image according to claim 1, wherein the photosensitive silver halide has a particle size of from 5 nm to 80 nm.

3. The process for forming an image according to claim 1, wherein the photosensitive silver halide comprises silver iodide in a ratio of 10% by mole or more.

4. The process for forming an image according to claim 1, wherein the photosensitive silver halide comprises silver iodide in a ratio of 40% by mole or more.

5. The process for forming an image according to claim 1, wherein the photosensitive silver halide comprises silver iodide in a ratio of 70% by mole or more.

6. The process for forming an image according to claim 1, wherein the photosensitive silver halide comprises silver iodide in a ratio of 90% by mole or more.

7. The process for forming an image according to claim 1, wherein the binder comprises polyvinyl butyral in an amount of 50% by weight or more.

8. The process for forming an image according to claim 1, wherein the photosensitive layer comprises 5 to 30% by weight of the non-photosensitive organic silver salt.

9. The process for forming an image according to claim 1, wherein the heat development is conducted with a heat drum thermal developing apparatus.

* * * * *